US007297172B2

(12) United States Patent
Lee

(10) Patent No.: US 7,297,172 B2
(45) Date of Patent: Nov. 20, 2007

(54) CYCLONE DUST COLLECTING APPARATUS OF VACUUM CLEANER

(75) Inventor: Byung-jo Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 634 days.

(21) Appl. No.: 10/836,387

(22) Filed: Apr. 30, 2004

(65) Prior Publication Data

US 2004/0244139 A1 Dec. 9, 2004

(30) Foreign Application Priority Data

Jun. 9, 2003 (KR) ..... 10-2003-0036888

(51) Int. Cl.
*B01D 45/12* (2006.01)

(52) U.S. Cl. ..... 55/337; 55/429; 55/459.1; 55/DIG. 3; 55/DIG. 34; 96/417

(58) Field of Classification Search ..... 55/337, 55/343, 345, 429, DIG. 3, DIG. 34, 459.1; 96/417

See application file for complete search history.

(56) References Cited

U.S. PATENT DOCUMENTS 5,135,552 A * 8/1992 Weistra ..... 55/337
6,607,572 B2 * 8/2003 Gammack et al. ..... 55/343

FOREIGN PATENT DOCUMENTS

| | | |
|---|---|---|
| GB | 2368269 | 5/2002 |
| KR | 1020020000415 | 1/2002 |
| WO | WO 02/067756 | 9/2002 |

* cited by examiner

*Primary Examiner*—Robert A. Hopkins
(74) *Attorney, Agent, or Firm*—Ladas & Parry LLP

(57) ABSTRACT

A cyclone dust collector of a vacuum cleaner includes a lower cyclone body for initially separating dust entrained in air drawn in through an air suction port, an upper cyclone body for separating fine dust entrained in the air that has been initially filtered in the lower cyclone body, and a central air path for guiding the air which is filtered in the upper cyclone body along a center axis line, and discharging the air through an air discharge port in the lower cyclone body. The capability of the vacuum cleaner can be improved by circulating the drawn in air having the entrained dust in the lower and upper cyclone bodies, and separately and sequentially collecting the dust at least partially based on the particle size thereof.

8 Claims, 8 Drawing Sheets

CYCLONE DUST COLLECTING APPARATUS OF VACUUM CLEANER

BACKGROUND OF THE INVENTION

1. Field of the Invention

The present invention relates generally to a cyclone dust collector of a vacuum cleaner, and more particularly, to a cyclone dust collector for collecting dust and dirt entrained in an air stream (hereinafter, referred to as 'dust') by centrifugally separating the same several times in successive, sequential steps.

2. Description of the Related Art

As shown in FIG. 1, which is a partially enlarged vertical section of a cyclone dust collector of a conventional vacuum cleaner, the general conventional cyclone dust collector comprises a cyclone body 110 and a filter 130 mounted in the cyclone body 110. In a device receiving unit 10 of a cleaner body 3 of FIG. 2, the cyclone dust collector 100 is mounted. Referring to FIG. 2, the following elements are disposed at the rear side of the device receiving unit 10: an air suction connection port 13 (shown in phantom) for drawing in air including entrained dust; and an air discharge connection port 14 for discharging clean air which is filtered in the cyclone dust collector 100, of FIG. 1, which is disposed within a receptacle 40 (FIG. 2) that can be removably inserted into the vacuum cleaner main body 3.

The cyclone body 110 comprises an air suction port 113 (shown in phantom) and an air discharge port 115, and also a dust receptacle 120 connected to a lower part of the cyclone body 110. The air suction port 113 is formed in a sidewall of the cyclone body 110 so as to introduce an air stream in a tangential direction, and is connected to the suction connection port 13 of the main body 3 of FIG. 2. The air flowing in through the suction connection port 13 is discharged into the cyclone body 110 through the air suction port 113, and generates a rotating or cyclonic air current. At this time, the dust in the air is separated by the centrifugal force of the rotating air and is collected in the dust receptacle 120. Preferably, the dust receptacle 120 is removably connected to the cyclone body 110.

The air discharge port 115 is disposed in a center portion of the upper part of the cyclone body 110, and is connected to the discharge connection port 14 (FIG. 2) of the cleaner main body 3. Accordingly, the air, from which the dust has been centrifugally separated in the cyclone body 110, is discharged through the discharge connection port 14.

Meanwhile, a filter 130 (FIG. 1) is disposed in the dust receptacle 120 and is in fluid communication with an opening of the air discharge port 115. The filter 130 filters fine dust particles entrained in the air after it has been centrifuged in the cyclone body 110. After the dust is removed through the filter 130, the clean air is discharged externally through the discharge connection port 14. Further, the filter 130 prevents a reverse current flow of the discharged air.

However, in the cyclone dust collector 100 of most conventional vacuum cleaners, dust, which is centrifugally separated and collected in the dust receptacle, is entrained and flows together with the rising air current, thereby generating noise when colliding with the filter 130. Further, the floating dust adheres to the surface of the filter 130, thereby impeding smooth flow of the air through the filtration section of the vacuum cleaner. In addition, a single filter 130 of the conventional cyclone dust collector cannot filter satisfactorily when there is a lot of dust in the drawn in air.

Therefore, the life span of each filter is significantly reduced, causing the concomitant inconvenience of requiring frequent replacement of filters.

SUMMARY OF THE INVENTION

It is an object of the present invention, considering the above problems, to provide a cyclone dust collector to improve the capability of a vacuum cleaner, by separately collecting dust entrained in drawn in air in sequential steps in decreasing order of the dust particle size.

Another object of the present invention is to provide a cyclone dust collector for a vacuum cleaner that decreases noise and prevents adhesion of dust to a filter.

Yet another object of the present invention is to provide a cyclone dust collector for a vacuum cleaner that is superior in removing dust despite large amounts of dust being entrained in the drawn in air. Preferably, the inventive vacuum cleaner does not need frequent replacement of the filter, and has a long life span.

In order to achieve the above-described objects of the present invention, there is provided a cyclone dust collector for a vacuum cleaner, comprising a lower cyclone body for initially separating dust entrained in air drawn in through an air suction port, an upper cyclone body for secondary separation of fine dust particles entrained in the air which is initially filtered in the lower cyclone body, and a central air path for guiding the air which has been initially filtered in the upper cyclone body along a center axis line, and discharging the air through an air discharge port disposed in the lower cyclone body.

Preferably, the lower and upper cyclone bodies respectively comprise air passage holes in contact with respect to a second central air path to supply the air initially filtered in the lower cyclone body to the upper cyclone body.

The central air path comprises an upper air path formed vertically along the center axis of the upper cyclone body, having an air outlet formed in an outer surface thereof, and a lower air path extending in a smooth bend from a center portion of the lower cyclone body toward the air discharge port. Here, it is preferable that a filter is further comprised outside of the upper air path.

Meanwhile, initial separation of the dust from the drawn in air is performed by a grill vertically mounted in the lower cyclone body to filter the air flowing therethrough, after the air passes through the air suction port and the air flow is directed to rotate in an air current and the dust entrained in the air is separated by the centrifugal force of the rotating air current.

Further, the dust collector may further comprise a removable dust receptacle connected to a lower part of the lower cyclone body to collect the dust which has been centrifugally separated inside the lower cyclone body.

Further, it is preferable that a dust amount determining unit is further comprised for indicating the amount of the dust which has been separated and collected in the upper cyclone body.

According to the present invention, there can be provided a cyclone dust collector of a vacuum cleaner which circulates the drawn in air in the lower and upper cyclone bodies, and separately collects the dust in sequence of the size thereof. Therefore, the dust collector according to the present invention efficiently removes dust regardless of the amount and has a longer life span since the filter does not have to be replaced often. Especially, according to the present invention, a noise of the cleaner and the dust adhering to the filter can be reduced.

BRIEF DESCRIPTION OF THE DRAWING FIGURES

These and other features, aspects, and advantages of the present invention will become better understood with regard to the following description, appended claims, and accompanying drawings wherein:

DETAILED DESCRIPTION OF THE PREFERRED EMBODIMENTS

Hereinafter, preferred embodiments of a cyclone vacuum cleaner according to the present invention will be described in detail with reference to the accompanying drawing figures.

Figure 1:
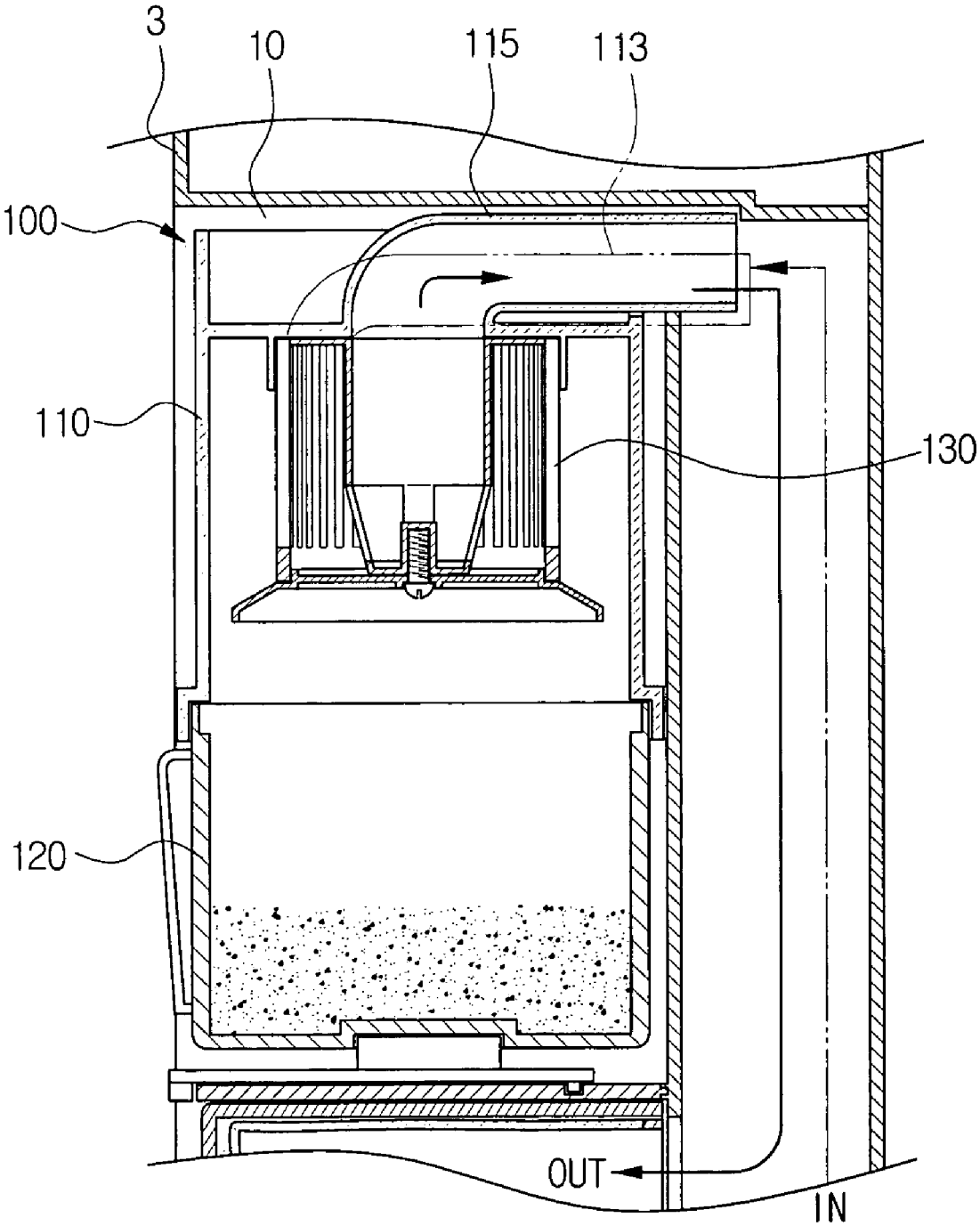
FIG. 1 (PRIOR ART)
FIG. 1 is a partially enlarged vertical sectional view of a conventional vacuum cleaner having a cyclone dust collector.
Figure 2:
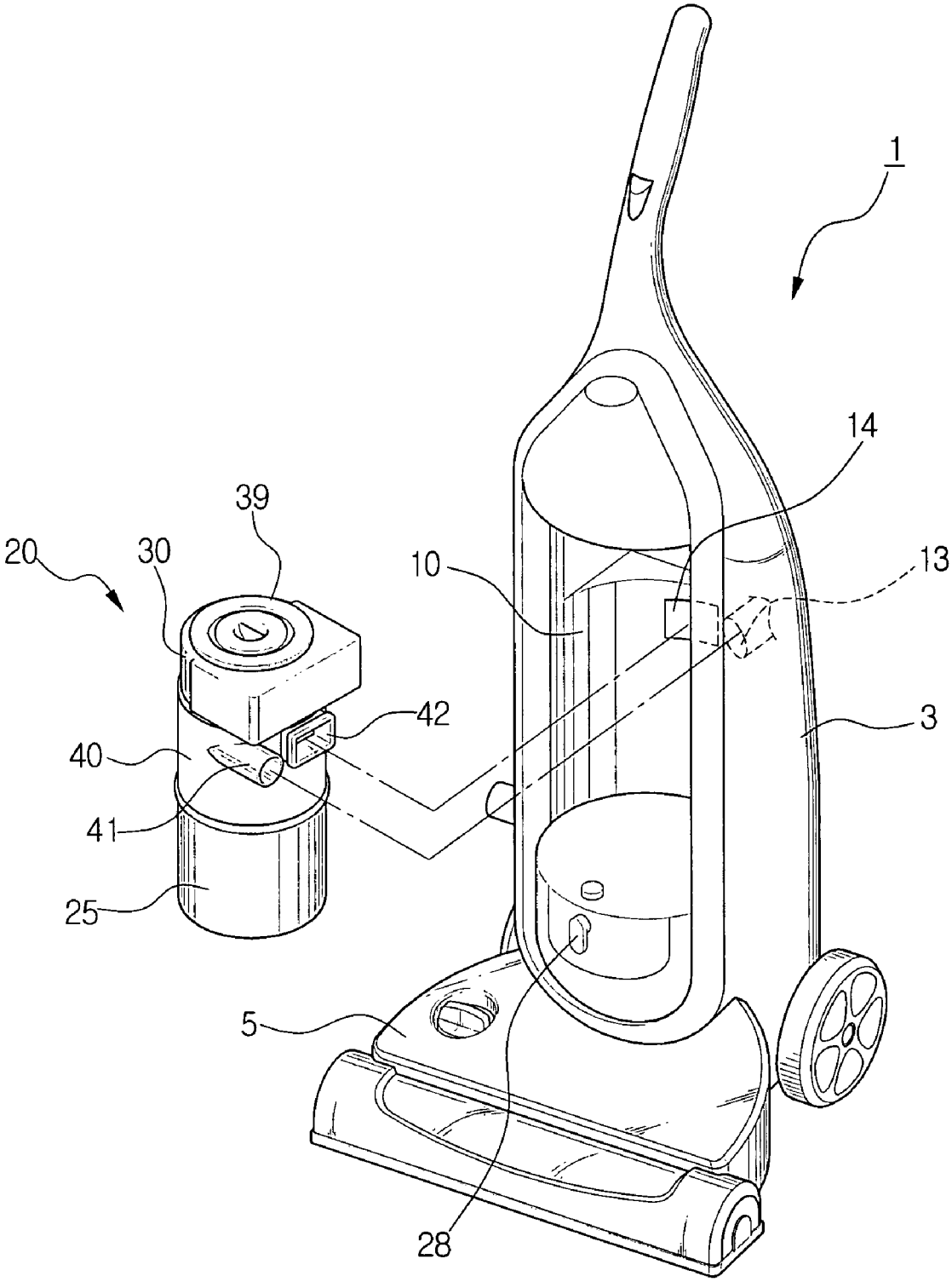
FIG. 2 is a perspective view of an upright type vacuum cleaner, comprising a cyclone dust collector according to the present invention.

FIG. 2 is a perspective view of an upright type vacuum cleaner, comprising a cyclone dust collector according to the present invention. The upright cyclone vacuum cleaner 1 includes a main body 3 of the vacuum cleaner 1, and a cyclone dust collector 20, which is removably mounted on the main body 3.

In the main body 3, a vacuum generating device (not shown) is mounted, and in a lower part of the main body 3, a suction brush 5 is mounted vacuuming dust by means of an external air flow. A device receiving chamber 10 is available for receiving the cyclone dust collector 20. The chamber 10 comprises an indent disposed in the center of the main body 3 for removably receiving the cyclone dust collector 20. On the rear side of the device receiving chamber 10, a suction connection port 13 (shown in phantom) is disposed for connection to the suction brush 5, and a discharge connection port 14 is provided for connection to the vacuum generating device.

Figure 3:
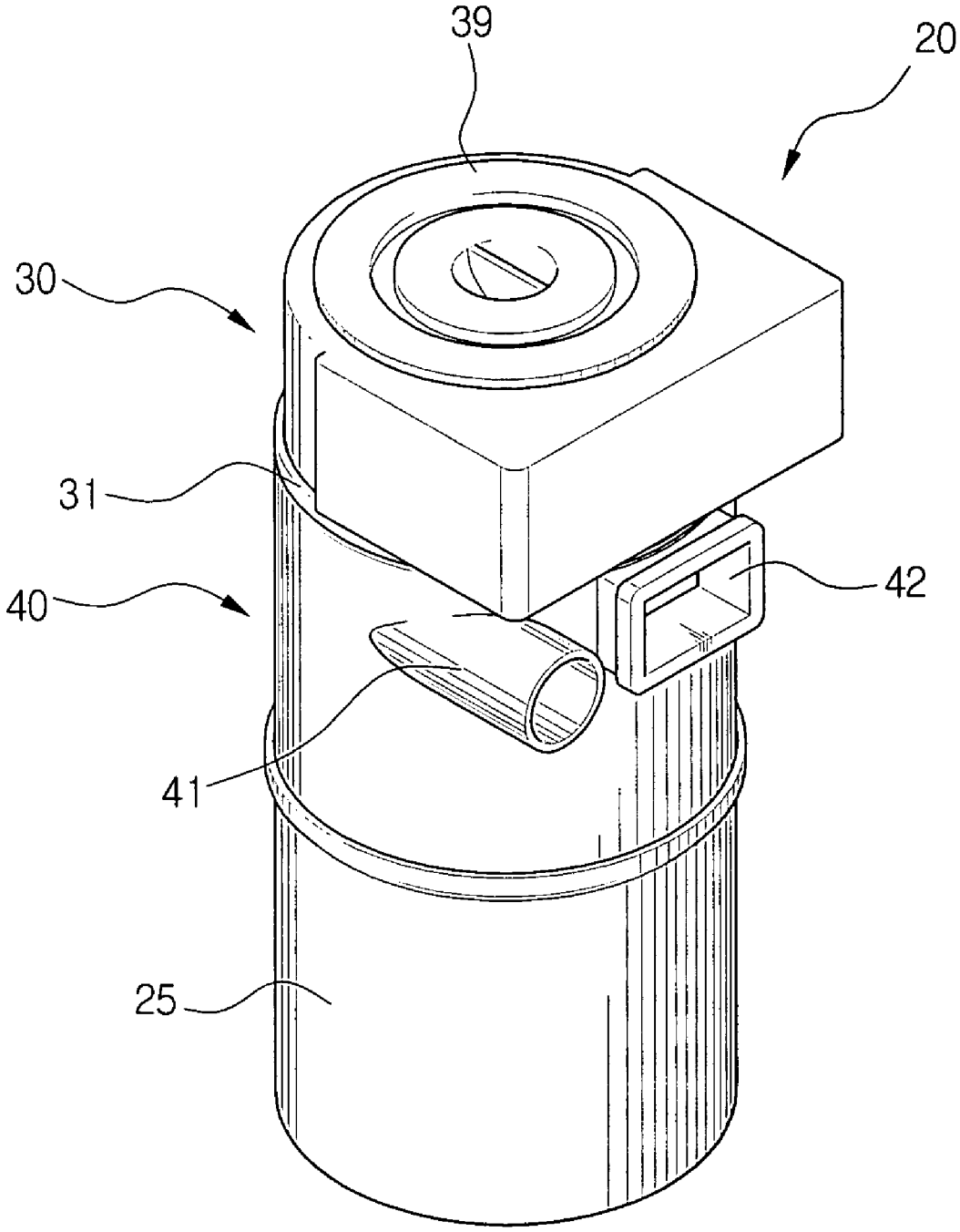
FIG. 3 is a perspective view illustrating the exterior of the cyclone dust collector, including an enlarged view of the main elements of FIG. 2.
Figure 4:
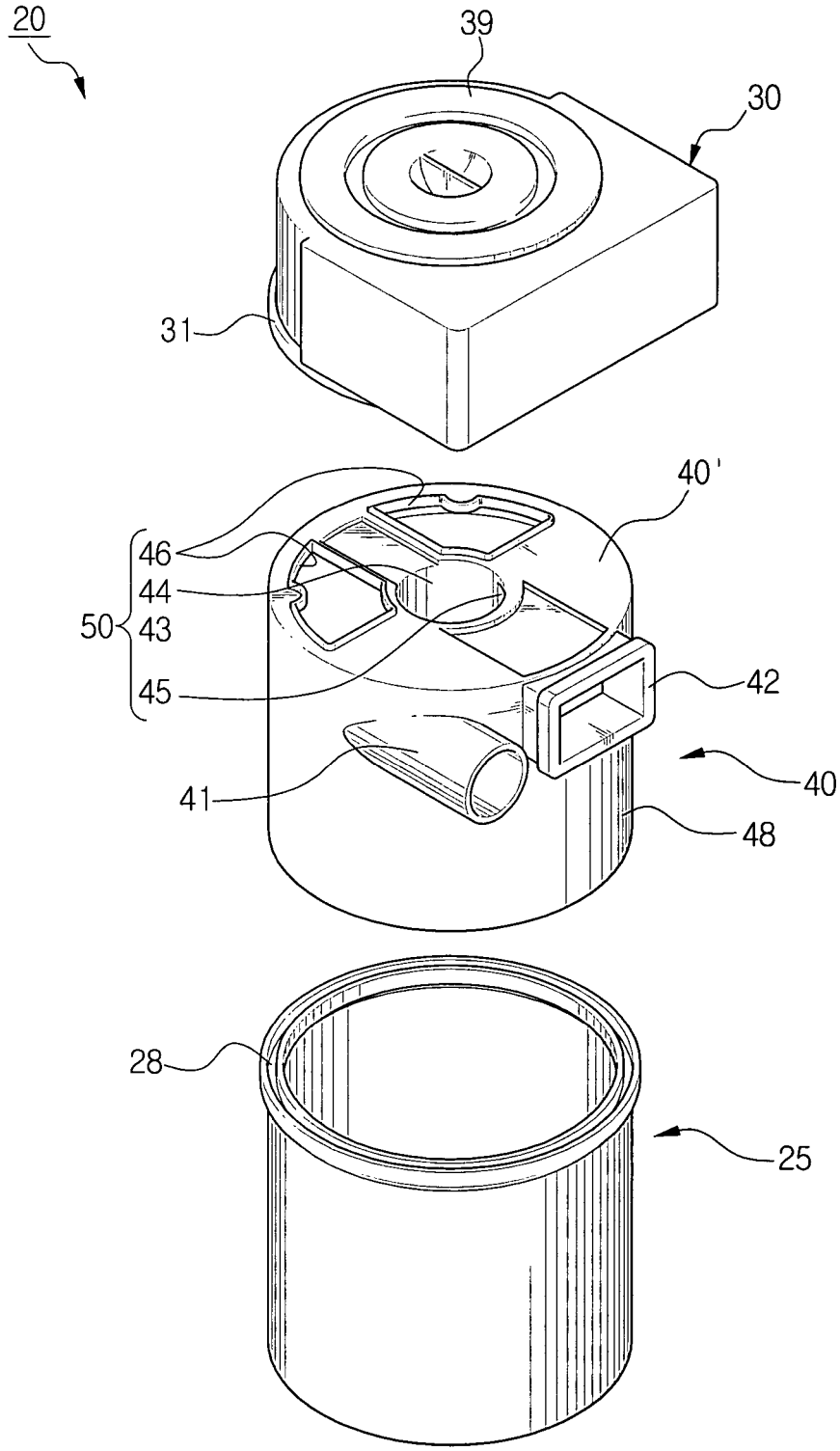
FIG. 4 is an exploded perspective view of the dust collector shown in FIG. 3.
Figure 5:
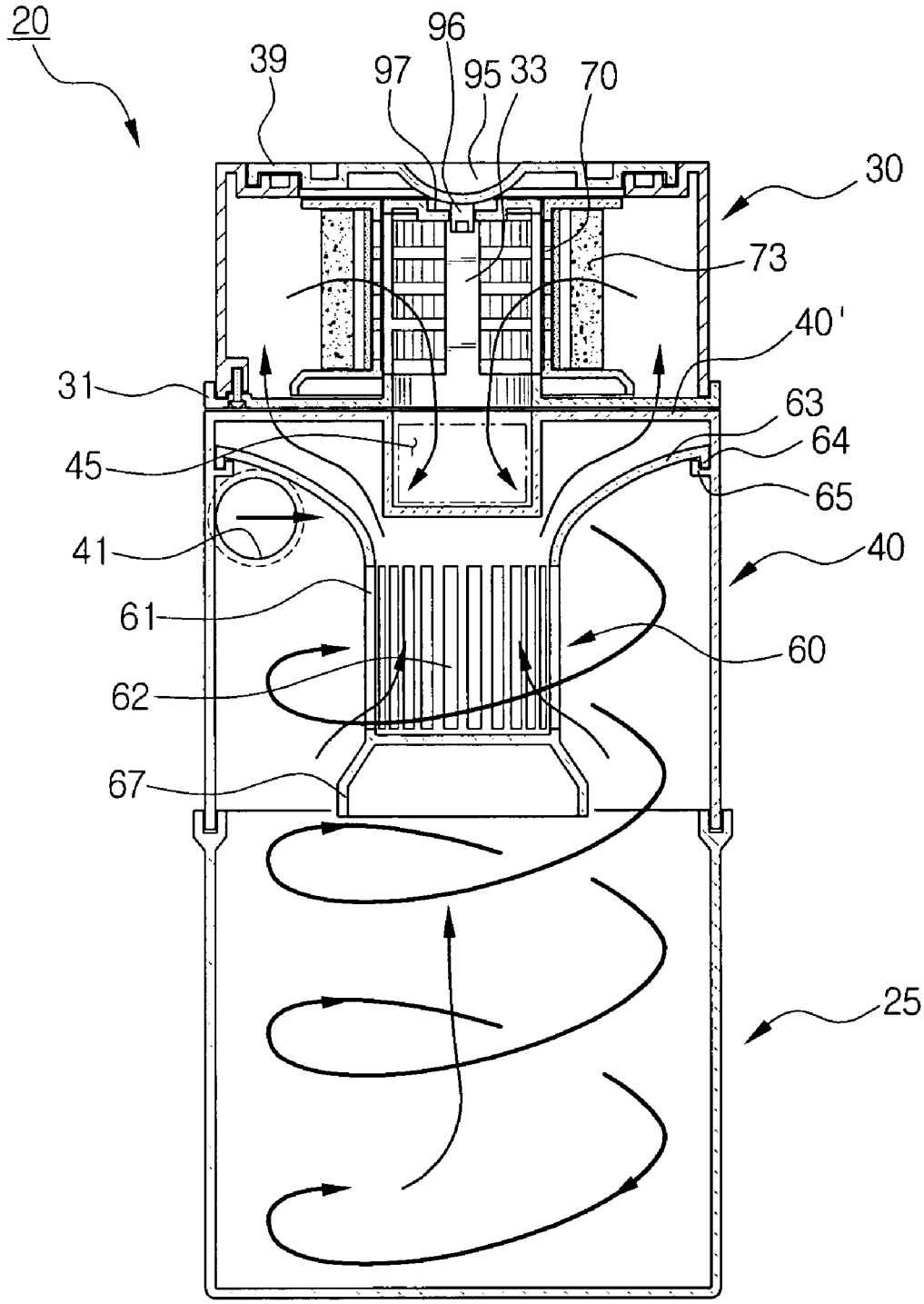
FIG. 5 is a cross-sectional view of the dust collector shown in FIG. 3.

FIG. 3 is an exterior, perspective view of the cyclone dust collector 20, the main elements of FIG. 2 being shown in greater detail. FIG. 4 is an exploded perspective view of the assembled dust collector 20 shown in FIG. 3, and FIG. 5 is a cross-sectional view of the assembled dust collector 20 shown in FIG. 3, illustrating the structure of the cyclone dust collector in greater detail.

As shown in the drawing figures, the cyclone dust collector 20 comprises a lower cyclone body 40 having an air suction port 41 and an air discharge port 42, an upper cyclone body 30, which is disposed above the lower cyclone body 40, and a dust receptacle 25, which is removably connected to the lower cyclone body 40. Internally within the lower and upper cyclone bodies 40, 30, an air path 50 is formed for circulating air and dust which is drawn in from the outside.

The lower cyclone body 40 preferably is in the shape of a cylinder, of which a bottom portion is open, having the air suction port 41 and the air discharge port 42 on the upper part of a sidewall thereof disposed at a predetermined distance from each other. The air suction port 41 is formed to extend in a tangential direction along the sidewall of the lower cyclone body 40, and is connected to the suction connection port 13 of the device receiving chamber 10. As the air is drawn into the cyclone body 40 through the air suction port 41, the air is directed in a rotational orientation so as to produce a rotating air current. The air discharge port 42 may be formed in a normal direction to the surface for connection to the discharge connection port 14 of the chamber 10.

Further, on an upper housing plate 40' of the lower cyclone body 40, an upwardly open lower center hole 44 is centrally disposed. The lower center hole 44 and the air discharge port 42 are in fluid communication with each other through a lower air path 45. The lower air path 45, as shown in phantom in FIG. 6 in greater detail, is formed along the bottom surface of the upper plate 40' of the lower cyclone body 40 in a radial direction thereof and extending away from the central hole 44. The lower air path 45 guides the air being discharged through the lower center hole 44 to the air discharge port 42. The lower air path 45 will be described in greater detail below with respect to engagement of the lower cyclone body 40 with the upper cyclone body 30.

In the upper plate 40' of the lower cyclone body 40, a plurality of lower air passage holes 46 are formed. More specifically, a pair of the lower air passage holes 46 are disposed around the lower center hole 44 on the left and right sides, respectively. Through the lower air passage holes 46, the air, which is initially separated in the lower cyclone body 40, is discharged through the lower air passage holes 46, and then flows into the upper cyclone body 30, as will be described in greater detail below.

In the lower cyclone body 40, a lower grill 60 (FIG. 5) is formed in an upright, vertically oriented position. The lower grill 60 comprises a lower grill unit 61, which is preferably cylindrical, an upper flange unit 63 and a lower flange unit 67, which are respectively formed on an upper part and a lower part of the lower grill unit 61. On the outer surface circumference of the lower grill unit 61, a plurality of parallel slits 62, (hereinafter, called lower slits) are formed in a vertically oriented direction. The upper flange unit 63 is shaped in an inverse truncated cone extending upwardly from an upper part of the lower grill unit 61, and is connected with an inside wall surface of the lower cyclone body 40. To provide a secure connection at the lower cyclone body 40, an end 6 of the upper flange unit 63 is bent downwardly. In addition, at an upper part of an inside surface wall of the lower cyclone body 40, a connection rib 65 is formed for providing a hooking engagement with the bent end 64 of the upper flange unit 63. The lower flange unit 67 is extended downwardly from the bottom part of the lower grill unit 61 and preferably takes the form of a bell shape, as shown.

In the lower cyclone body 40, the drawn in air, which is introduced through the air suction port 41, forms a rotating air current centering about the lower grill 60. At this time, the dust in the drawn in air is initially separated by the centrifugal force of the air of the rotating air current, and is collected by the action of gravity in the dust receptacle 25.

The dust receptacle 25 is removably connected at the lower part of the lower cyclone body 40, and therefore, dust collected therein can be easily removed by separating the dust receptacle 25 from the lower cyclone body 40 for emptying. Along an upper rim of the dust receptacle 25, a connection groove 28 (FIG. 4) is formed in a circumferential direction, and the lower end of the lower cyclone body 40 provides a protrusion that can be force-fit into the connection groove 28.

The air, which is initially separated in the lower cyclone body 40, is passed through the lower grill 60 and then is upwardly discharged. Here, since the lower slits 62 of the lower grill 60 are of a predetermined size, dust of a relatively large particle size of the discharged air current is blocked, while the air passes through the lower grill 60. At this stage, the lower grill 60 can not block fine dust particles, for example, those under a certain size. Accordingly, the air may still include fine dust particles as it is directed into the upper cyclone body 30.

Figure 7:
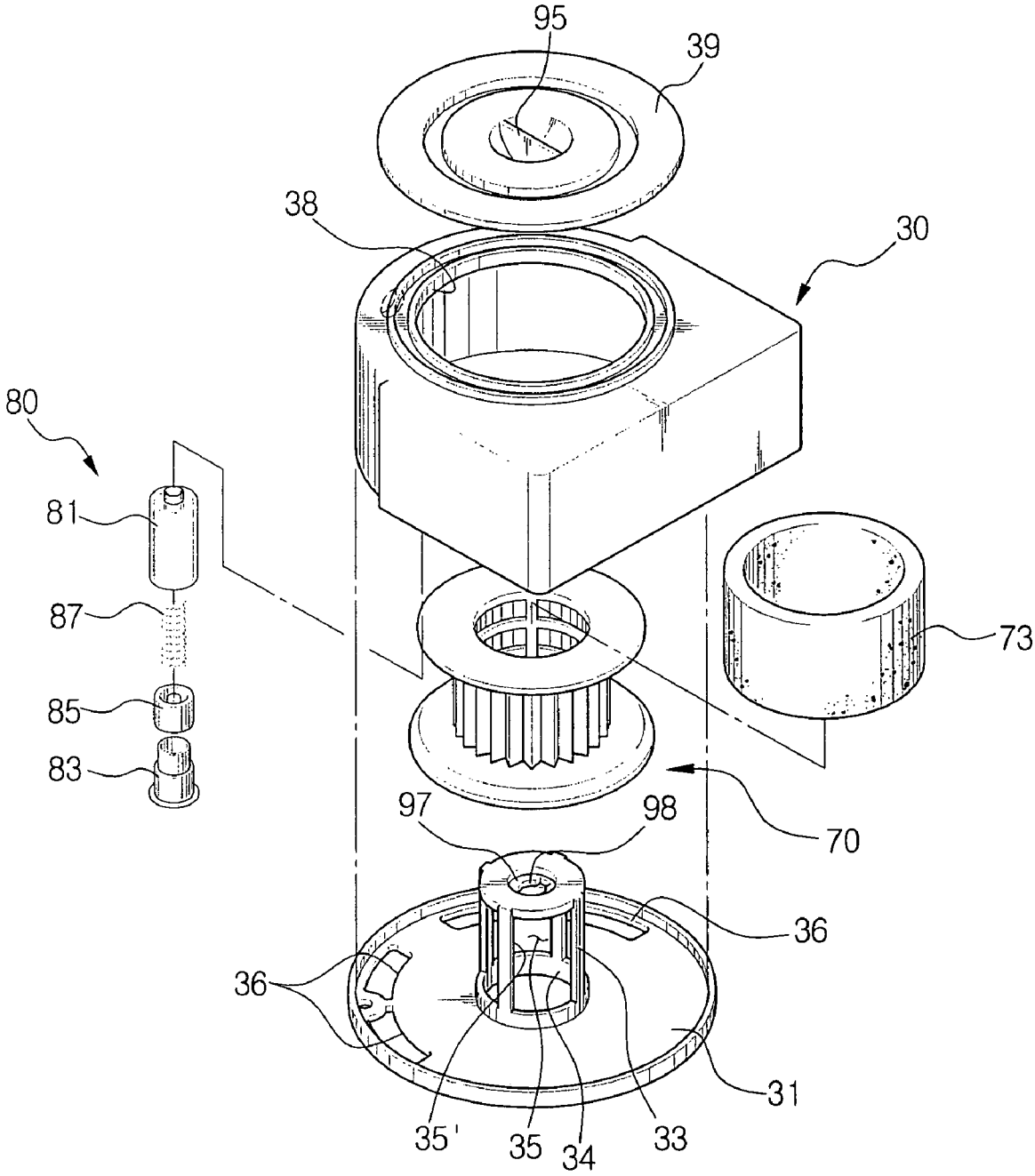
FIG. 7 is an exploded perspective view of the upper cyclone body.

FIG. 7 is an exploded perspective view of an upper cyclone body 30. The upper cyclone body 30 preferably has a cylindrical shape with the top being open, and includes an upper cover 39 removably connected with the top opening thereof. On a bottom plate 31 of the upper cyclone body 30, a plurality of upper air passage holes 36 are disposed to permit the air flowing in from the lower cyclone body 40 and an upper center hole 34 is provided for discharging the air inside thereof. In addition, an upper air path 33 projects upwardly and is disposed centrally of the upper air passage hole 36, and a plurality of air outlets 35 are formed circumferentially at an outside of the upper air passage hole 36.

The upper center hole 34 and upper air passage holes 36 of the upper cyclone body 30 are formed corresponding to the positions of the lower center hole 44 and the lower air passage holes 46, respectively, of the lower cyclone body 40. Accordingly, the air in the upper cyclone body 30 is permitted to flow out through the air outlets 35, and then is discharged through the upper center hole 34. The upper air path 33 of the upper cyclone body 30 and the lower air path 45 of the lower cyclone body 40 are in fluid communication to each other, thereby forming a center air path 51 (FIG. 7) of the cyclone dust collector 20 according to the present invention.

The air outlets 35 of the upper air path 33 can serve as a filter unit, in the same manner as the lower grill 60. However, for more effective filtering of the fine dust particles, it is more preferable that a fine particle filter 70 is mounted circumferentially outside of the air outlets 35. Accordingly, after the initial separation of the dust, fine dust particles, which are still entrained in the air, are separated from the air stream by a secondary filtering process. More preferably, a porous filtering member 73 is mounted outside of the filter 70. The porous filtering member 73 improves dust filtering and collecting efficiency and the life span of the filter 70.

Figure 6:
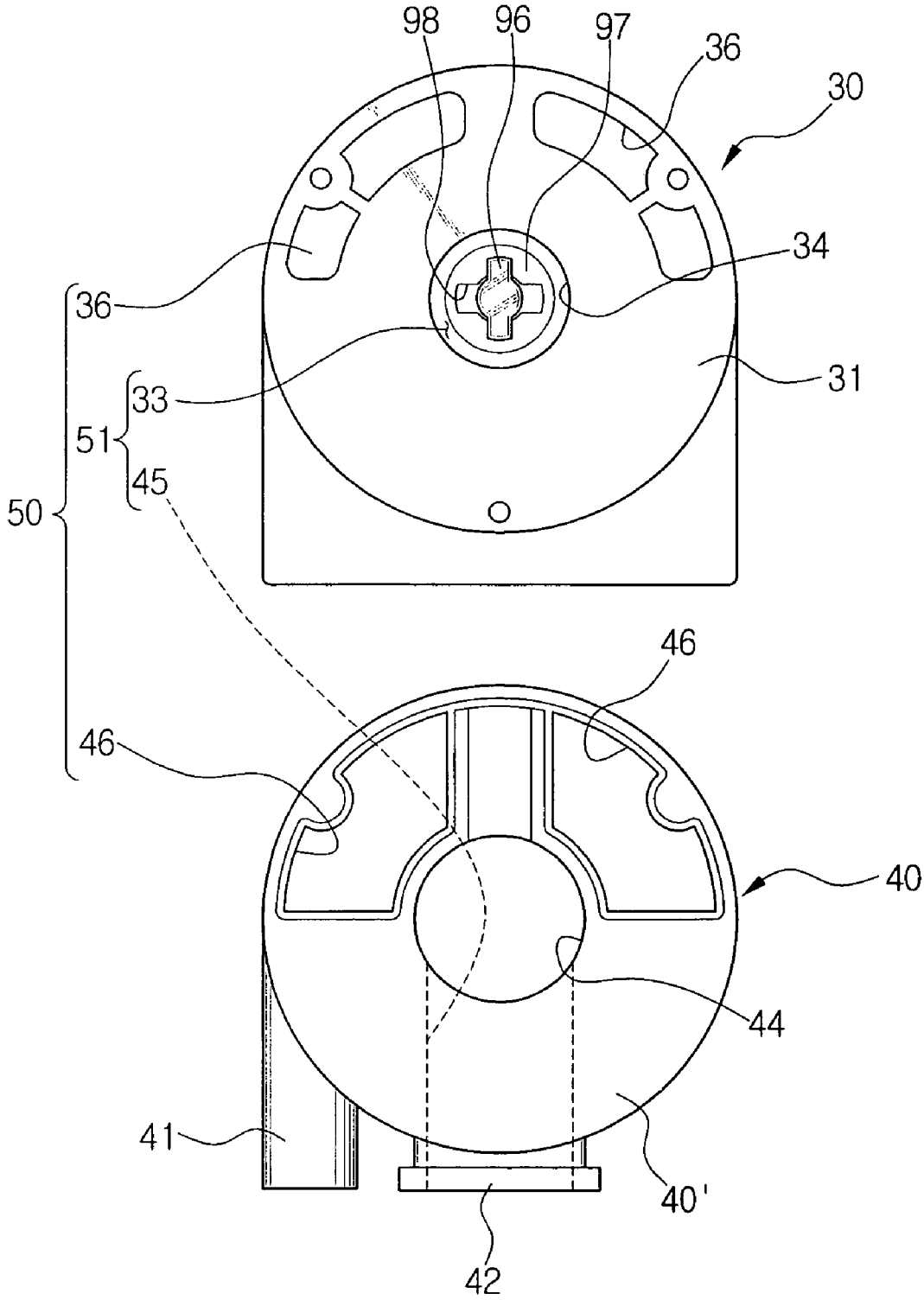
FIG. 6 shows a top view of the lower cyclone body with a corresponding bottom view of the upper cyclone body as shown in FIG. 4, illustrating the engagement therebetween and the air path.

Here, the bottom plate 31 of the upper cyclone body 30 can be formed separately, as specifically shown in FIG. 6. In the case of a separate manufacturing process step of the bottom plate 31, it is preferable that the upper center hole 34, the upper air passage holes 36, and the upper air path 33 are integrally formed by injection molding. As shown in FIG. 5, bottom plate 31 may be connected to the housing upper cyclone body 30 by using a plurality of connection members, such as the screws shown.

An upper cover 39 covers the top of the upper cyclone body 30, and an operation knob 95 projects in a depression to provide a hold for a user. A connection projection 96 is projected downwardly under the upper cover 39, and a locking hole portion 97 is formed to fit in with and engage the connection projection 96 on top of the upper air path 33. In the locking hole portion 97, a long hole 98 (FIG. 7) is formed extending in one direction, to receive the connection projection 96 therethrough into the locking hole portion 97. The connection projection 96 inserted into the locking hole portion 97 is rotatable by the operation knob 95 for switching between a locked position and an unlocked position by rotation of the operation knob 95.

The above-structured cyclone dust collector 20 of a vacuum cleaner is removably connected to the device receiving chamber 10 of the main body 3 of the vacuum cleaner.

The dust receptacle 25 is removed or replaced while being connected with the lower cyclone body 40, and the upper cyclone body 30 is connectable with the lower cyclone body 40, either integrally or separately. When the lower cyclone body 40 is received within the chamber 10, the air suction port 41 and the air discharge port 42 are connected, respectively, to the suction connection port 13 and the discharge connection port 14, which extend from the device receiving chamber 10. To securely engage the upper cyclone body 30 to the upper part of the lower cyclone body 40, it is preferable that a seating guide groove is formed in the upper plate 40' of the lower cyclone body 40.

When the device is switched on, the vacuum generating device (not shown) is driven. At this time, the air in which dust and dirt are entrained, is drawn in through the suction brush 5, and is discharged to the air suction port 41 of the lower cyclone body 40 through the suction connection port 13. The discharged air including the entrained dust is directed to produce a rotating air current in the lower cyclone body 40, and thereby the dust is first separated by the centrifugal force of the cyclonic air stream. The separated dust is collected in the dust receptacle 25. The filtered air passes through the lower grill 60 and then rises into the upper cyclone body 30 through the air passage holes 46, 36. Here, the lower grill 60 blocks relatively large particles of dust in the air which has been filtered once.

Meanwhile, the air discharged into the upper cyclone body 30 moves to the upper air path 33 in which the air outlets 35 are formed. At this time, the filter 70 filters fine dust particles entrained in the air in a secondary filtration process. After the air has been filtered, the fine dust particles drop to the bottom of the chamber to be collected in the upper cyclone body 30. After the fine dust particles are separated, the air is discharged into the air discharge port 42 sequentially through the air outlet 35 of the upper air path 33 and the lower air path 45.

In the lower and upper cyclone bodies 40, 30, the amount of dust gradually increases with continued collection thereof. Relatively large dust particles, which are collected in the lower cyclone body 40, are removed by separating the dust receptacle 25 from the lower cyclone body 42 and emptying it. In order to withdraw the lower cyclone body 40 and the dust receptacle 25 from the device receiving chamber 10, a withdraw lever 28, shown in FIG. 2, is operated. That is, the dust receptacle 25, which is hooked in the device receiving chamber 10, can be separated by turning the withdraw lever 28. To remove the fine dust particles collected in the upper cyclone body 30, the upper cyclone body 30 is withdrawn first, and then the upper cover 39 is separated therefrom before emptying.

Figure 8:
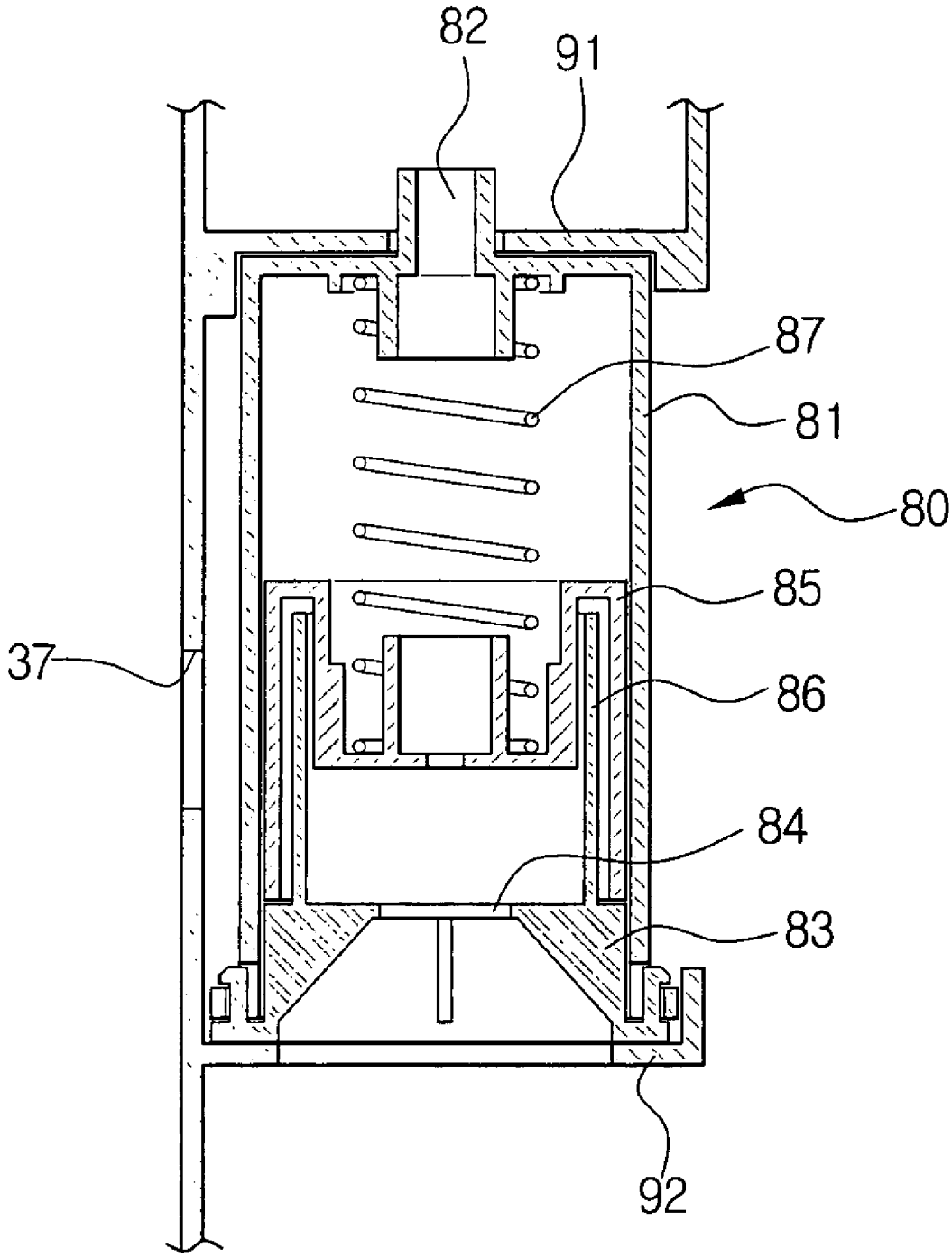
FIG. 8 is a partially enlarged cross-sectional view of FIG. 7, showing in detail the assembled structure of the inventive dust amount determining unit.

The amount of collected dust is monitored by a dust determining unit 80, which is mounted in the upper cyclone body 30, to indicate the amount of the collected dust. FIG. 8 is a partially enlarged section of FIG. 7, showing in detail the structure of the dust amount determining unit 80. As shown in FIG. 8, the dust amount determining unit 80 comprises a casing 81, an over dust indicator 83 to be connected within the casing 81, a standard dust indicator 85 which is movable between a cover position and an exposure position of the over dust indicator 83, and a spring 87 for elastically biasing the standard dust indicator 85 toward the cover position.

The casing 81 preferably is made of a transparent material, having an outlet 82 at an end thereof. The over dust indicator 83 is connected to a lower part of the casing 81 at the opposite end from outlet 82, and has a pressure inlet 84 on the bottom thereof. The over dust indicator 83 comprises an indication unit 86, which extends upwardly along the casing 81 in a longitudinal direction. The standard dust indicator 85 receives the indication unit 86 of the over dust indicator 83, all encompassed within the casing 81. Further, the spring 87 is disposed between the standard dust indicator 85 and the opening 82 of the casing 81.

The dust amount determining unit 80 preferably is fixed to a front portion of the upper cyclone body 30. Brackets 91, 92 are oppositely disposed at the top and bottom of the front portion of the upper cyclone body 30. Here, the pressure inlet 84 of the standard dust indicator 85 is in fluid communication with the inside of the upper cyclone body 30, and the air outlet 82 of the casing 81 is in fluid communication with the external air. Additionally, on the front portion of the upper cyclone body 30, on which dust amount determining unit 80 is fixed, there is disposed an observation window 37 that is open in order to provide visibility to the internal elements of unit 80. The user can check the status of the dust amount determining unit 80 through the observation window 37.

In the above described structure, when the amount of dust in the upper cyclone body 30 is under a predetermined threshold, the air flows in through the upper air passage hole 36 and is smoothly discharged through the air discharge port 42 passing through the filter 70 and the upper air path 33. When the air flow is unimpeded, both the inside and outside of the upper cyclone body 30 are at the same air pressure so that the dust amount determining unit 80 is exposed through the observation window 37, since the dust indicator 85 is in a position that blocks the over dust indicator 83 because of the elastic recovery force of the spring 87.

On the other hand, when the amount of dust is over the predetermined threshold to the extent that the collected dust requires removal, the inside air pressure becomes relatively higher than the outside air pressure, since the airflow of the inside is impeded. Then, the inside air pressure provides a force to the pressure inlet 84 of the standard dust indicator 85, thereby pressing the standard dust indicator 85. Accordingly, the standard dust indicator 85 exposes the over dust indicator 83, and the over dust indicator 83 is seen through the observation window 37. As a result, the user becomes aware of excessive dust in the upper cyclone body 30, and can withdraw the upper cyclone body 30 from the device receiving unit 10 to remove the dust, when it is convenient to do so.

While the invention has been shown and described with reference to specific preferred embodiments thereof, it will be understood by those skilled in the art that various modifications, alterations and changes in form and detail may be made to the disclosed invention without departing from the spirit and scope of the invention as defined by the appended claims.

What is claimed is:

1. A cyclone dust collector of a vacuum cleaner comprising:

a lower body for initially separating dust particles entrained in air drawn in through an air suction port;

an upper body for secondary separation of fine dust particles entrained in the air which has been initially filtered in the lower body; and a central air path for guiding the air which has been initially filtered in the upper body along a center axis line, and discharging the air through an air discharge port disposed in the lower body, the central air path comprised of an upper air path formed vertically along a center axis of the upper body, and having an air outlet formed in an outer surface thereof; and a lower air path extending in a smooth bend from a center portion of the lower body toward the air discharge port.

2. The cyclone dust collector of claim 1, wherein the lower and upper bodies respectively comprise air passage holes disposed in fluid communication with respect to a second central air path to supply the air initially filtered in the lower body to the upper body.

3. The cyclone dust collector of claim 1, further comprising a filter mounted outside of the upper air path.

4. The cyclone dust collector of claim 1, wherein the upper body further comprises an upper cover, which is openable to remove dust collected therein.

5. The cyclone dust collector of claim 4, wherein a the upper cover includes means for opening thereof comprising:

a locking hole portion formed adjacent the top of the upper air path of the central air path;

a connection projection formed on a lower surface of the upper cover to be connected with the locking hole portion; and an operation knob projecting upwardly from adjacent the top of the upper cover.

6. The cyclone dust collector of claim 1, wherein initial separation of the dust particles entrained in the drawn in air is performed by a grill vertically mounted in the lower body to filter the air passing therethrough, after the air is drawn in through the air suction port, the air flow is directed into a rotating air current and the dust entrained in the air is separated by the centrifugal force of the rotating air current.

7. The cyclone dust collector of claim 6, further comprising a removable dust receptacle connected to a lower part of the lower body to collect the dust which has been centrifugally separated inside the lower body.

8. The cyclone dust collector of claim 1, further comprising a dust amount determining unit for indicating the amount of dust which has been separated and collected in the upper body.

* * * * *